US007775601B2

(12) United States Patent
Wu

(10) Patent No.: US 7,775,601 B2
(45) Date of Patent: Aug. 17, 2010

(54) BACK STRUCTURE FOR A CHAIR

(76) Inventor: Yao-Chuan Wu, No. 1-1, Nei Pu Tsai, Ta Chi Tsun, Minhsiung Hsiang, Chiayi Hsien (TW) 621

( * ) Notice: Subject to any disclaimer, the term of this patent is extended or adjusted under 35 U.S.C. 154(b) by 176 days.

(21) Appl. No.: 12/049,419

(22) Filed: Mar. 17, 2008

(65) Prior Publication Data

US 2009/0230751 A1 Sep. 17, 2009

(51) Int. Cl.
*A47C 7/02* (2006.01)

(52) U.S. Cl. ..... 297/452.3; 297/230.14; 297/301.1

(58) Field of Classification Search ..... 297/452.18, 297/230.13, 230.14, 452.3, 452.56, 299, 297/301.1
See application file for complete search history.

(56) References Cited

U.S. PATENT DOCUMENTS 6,257,665 B1 * 7/2001 Nagamitsu et al. ..... 297/285
6,439,661 B1 * 8/2002 Brauning ..... 297/300.2
6,729,691 B2 * 5/2004 Koepke et al. ..... 297/452.56
7,014,269 B2 * 3/2006 Coffield et al. ..... 297/452.56
7,568,765 B2 * 8/2009 Brauning ..... 297/354.1

* cited by examiner

*Primary Examiner*—Sarah B McPartlin
(74) *Attorney, Agent, or Firm*—Alan Kamrath; Kamrath & Associates PA

(57) ABSTRACT

A rack structure for a chair includes a chair back member having a frame and a mounting support. The frame includes a support cushion disposed on the front side thereof for supporting a user's waist correspondingly. The frame further includes two first connecting tabs fixed on the back sides of the top ends of two sides thereof individually and two second connecting tabs formed on and extending from the two sides thereof respectively. The mounting support is fixed onto a base and extends upwardly therefrom. The mounting support includes two coupling segments and two connecting projections arranged on the top ends and the intermediate sections of two sides thereof respectively. Between each coupling segment and each connecting projection is couplingly attached a resilient member. The first and second connecting tabs of the frame are connected with the coupling segments and the connecting projections of the mounting support individually.

2 Claims, 6 Drawing Sheets

BACK STRUCTURE FOR A CHAIR

BACKGROUND OF THE INVENTION

1. Field of the Invention

The present invention relates to a rack structure, and more particularly to a rack structure for a chair that may maintain the user's correct sitting posture by swing the frame thereof.

2. Description of the Prior Arts

For comfort, most chairs are equipped with a back rack. Therefore the rack structure will be a requirement for a comfortable chair.

A conventional rack structure includes a frame comprised of a back plate (the back plate includes soft materials, such as foam material, filled therein) for providing comfort as a user sits on the chair and lays against its back. However, such a conventional chair can not make the user correct his sitting posture if sitting on the chair in an incorrect manner, causing fatigue.

The present invention has arisen to mitigate and/or obviate the afore-described disadvantages.

SUMMARY OF THE INVENTION

The primary object of the present invention is to provide a rack structure for a chair that may maintain a user's correct sitting posture by swinging the frame thereof.

In accordance with one aspect of the present invention, there is provided a rack structure for a chair including a chair back member comprised of a frame and a mounting support.

The frame includes a support cushion disposed on the front side thereof for supporting a user's waist correspondingly. The frame further includes two first connecting tabs fixed on the back sides of the top ends of two sides thereof individually and two second connecting tabs formed on and extending from the two sides thereof respectively.

The mounting support is fixed onto a base and extends upwardly therefrom. The mounting support includes two coupling segments and two connecting projections arranged on the top ends and the intermediate sections of two sides thereof respectively. Between each coupling segment and each connecting projection is couplingly attached a resilient member. The first and second connecting tabs of the frame are connected with the coupling segments and the connecting projections of the mounting support individually. Hence, the frame may be assembled onto the chair by way of the mounting support.

In operation, the frame may be used to support the user comfortably. However, if the user lays on and against the support cushion in an incorrect posture and since the support cushion pressed by the user is located beneath the second connecting tab and the resilient member is attached between the coupling segment and the connecting projection, the user presses the bottom of the frame to swing rearward and the top end of the frame is urged to pull the resilient members to become bent frontward so as to support and conform the shape of the user's back for recovering correct lying postures. On the contrary, if the user lays and against the upper side of the frame by his upper back, the bottom of the frame may swing frontward by using the resilient members so that the support cushion may move frontward to support the user, obtaining comfort with his changing postures.

To accommodate different users, each of two sides of the frame is provided with a continuous arcuate groove, and each of two ends of the support cushion is disposed with an arcuate protrusion for being fixed into the continuous arcuate groove by an elongated press member. The support cushion may be adjusted upward and downward relative to the frame, thus maintaining the correct sitting posture.

Furthermore, the support cushion includes foam materials filled therein for increasing comfort.

The present invention will become more obvious from the following description when taken in connection with the accompanying drawings, which show, for purpose of illustration only, the preferred embodiment in accordance with the present invention.

DETAILED DESCRIPTION OF THE PREFERRED EMBODIMENT

Figure 1:
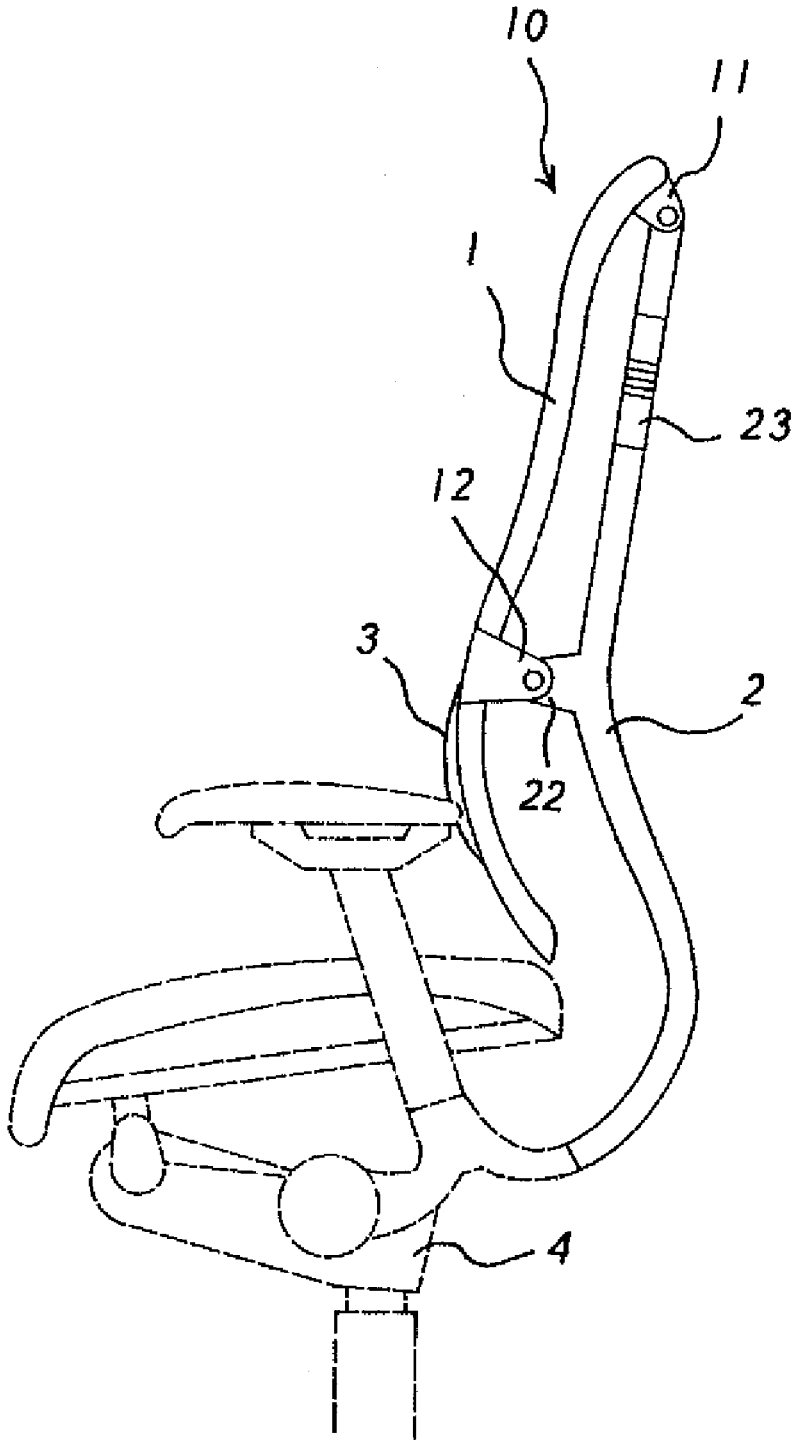
FIG. 1 is a side plan diagram illustrating the assembly of a rack structure for a chair according to the present invention.
Figure 2:
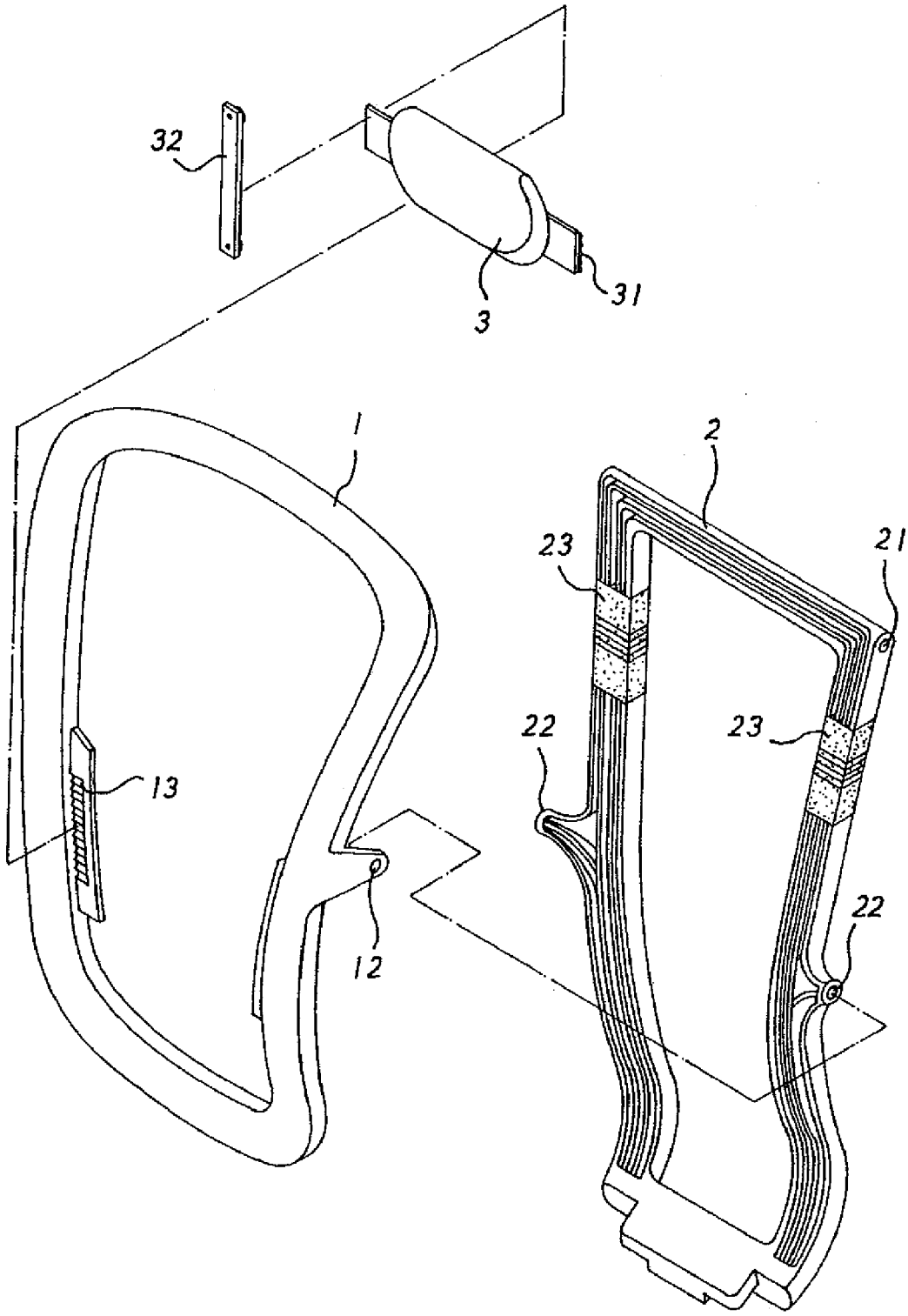
FIG. 2 is a perspective diagram illustrating the exploded components of the rack structure for the chair according to the present invention.
Figure 3:
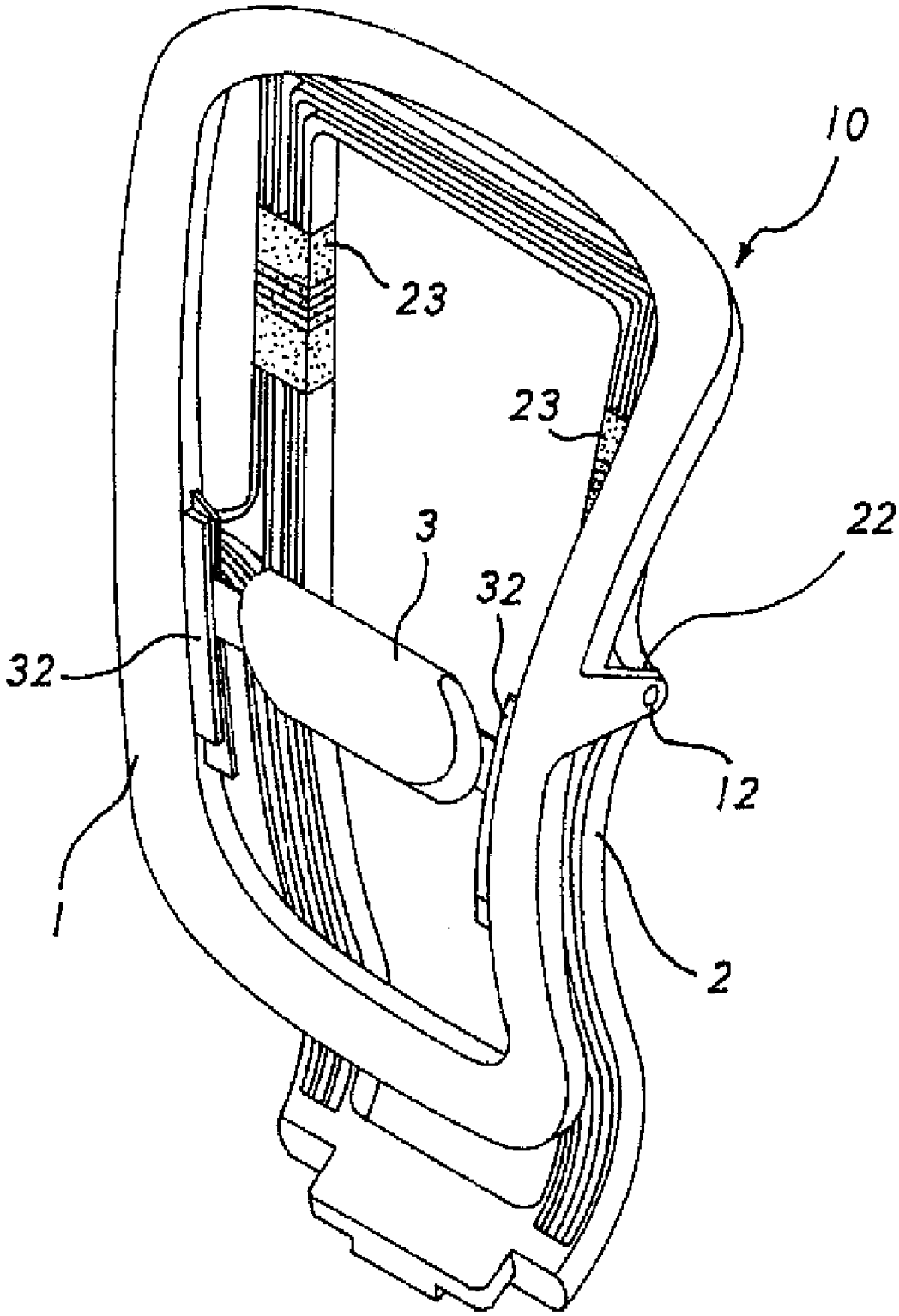
FIG. 3 is a perspective diagram illustrating the assembly of the rack structure for the chair according to the present invention.
Figure 4:
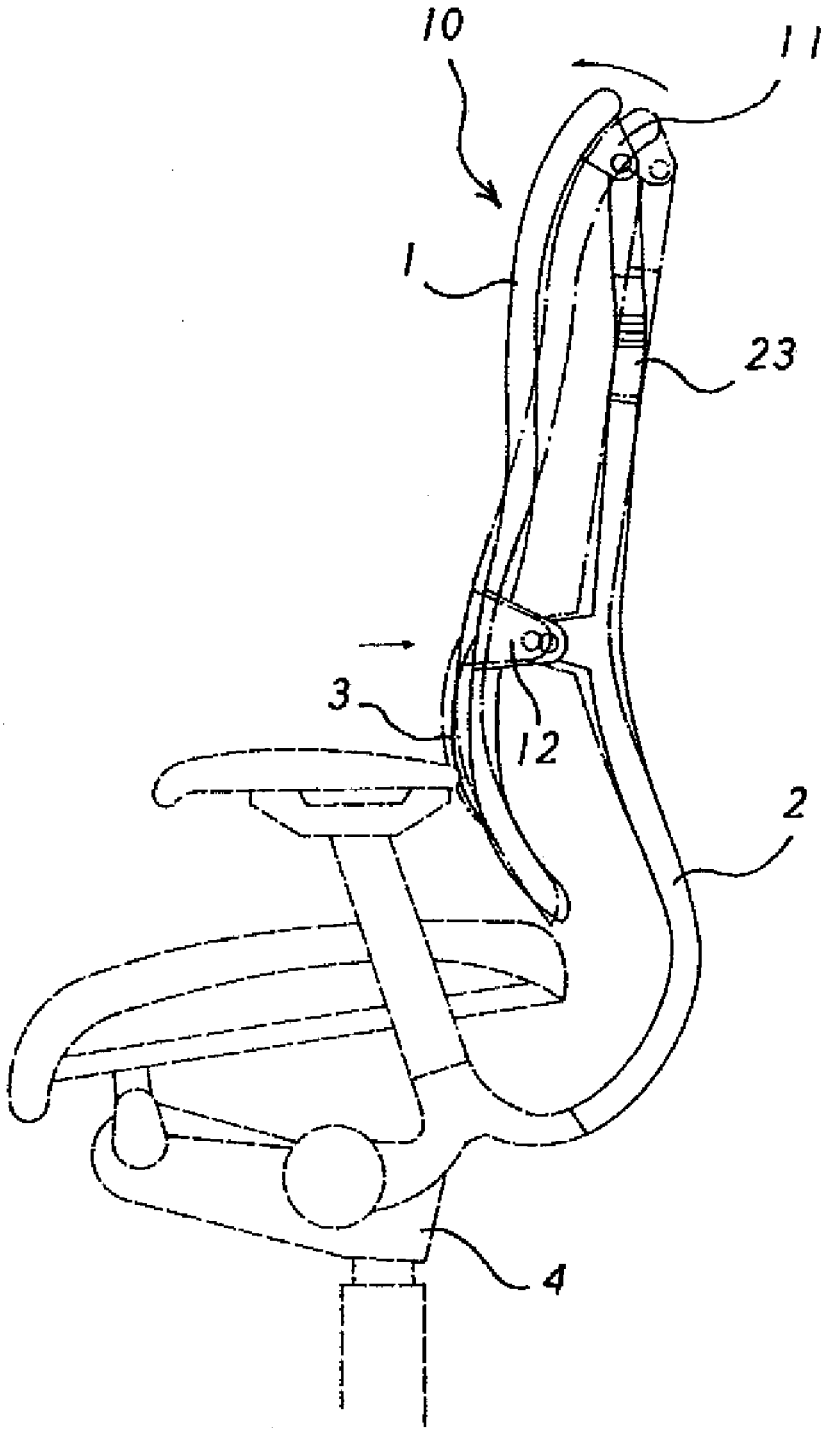
FIG. 4 is a side plan diagram illustrating the operational status of the rack structure for the chair according to the present invention.
Figure 5:
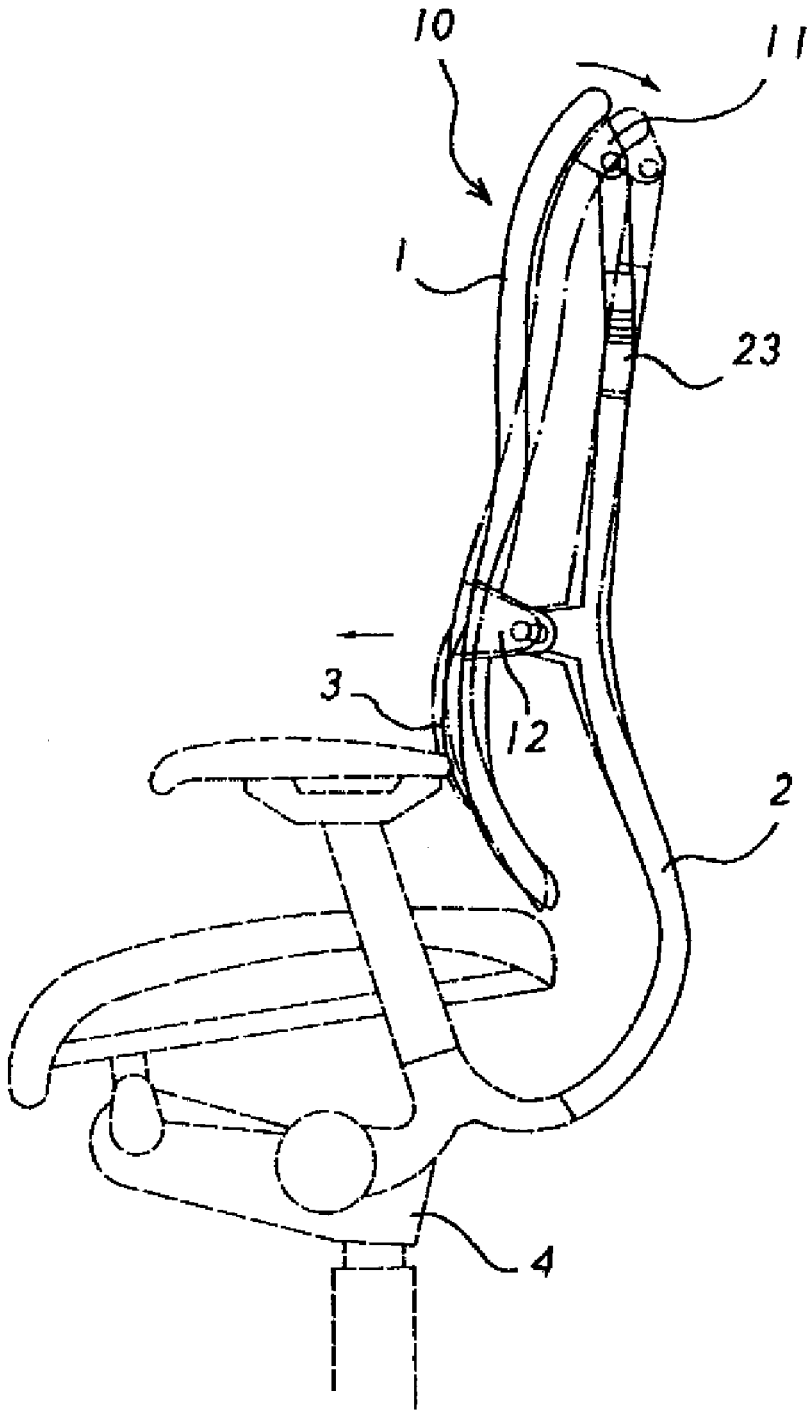
FIG. 5 is another side plan diagram illustrating the operational status of the rack structure for the chair according to the present invention.

Referring to FIGS. 3-5, a rack structure for a chair in accordance with the present invention includes a chair back member 10 comprised of a frame 1 and a mounting support 2 (as shown in FIGS. 1 and 2).

The frame 1 includes a support cushion 3 disposed on the front side thereof for supporting a user's waist correspondingly. The frame 1 further includes two first connecting tabs 11 fixed on the back sides of the top ends of two sides thereof individually and two second connecting tabs 12 formed on and extending from the two sides thereof respectively.

The mounting support 2 is fixed onto a base 4 and extends upwardly therefrom. The mounting support 2 includes two coupling segments 21 and two connecting projections 22 arranged on the top ends and the intermediate sections of two sides thereof respectively. Between each coupling segment 21 and each connecting projection 22 is couplingly attached a resilient member 23. The first and second connecting tabs 11, 12 of the frame 1 are connected with the coupling segments 21 and the connecting projections 22 of the mounting support 2 individually (as illustrated in FIG. 3). Hence the frame 1 may be assembled onto the chair by way of the mounting support 2.

In operation, the frame 1 may be used to support the user comfortably. However, if the user lays on and against the support cushion 3 in an incorrect posture and since the support cushion 3 pressed by the user is located beneath the second connecting tab 12 and the resilient member 23 is attached between the coupling segment 21 and the connecting projection 22, the user presses the bottom of the frame 1 to swing rearward and the top end of the frame 1 is urged to pull the resilient members 23 to become bent frontward (as shown in FIG. 4) so as to support and conform the shape of the user's back for recovering a correct lying posture. On the contrary, if the user lays against the upper side of the frame 1 by his upper back, the bottom of the frame 1 may swing frontward (as illustrated in FIG. 5) by using the resilient members 23 so that the support cushion 3 may move frontward to support the user, obtaining comfort with changing postures.

Figure 6:
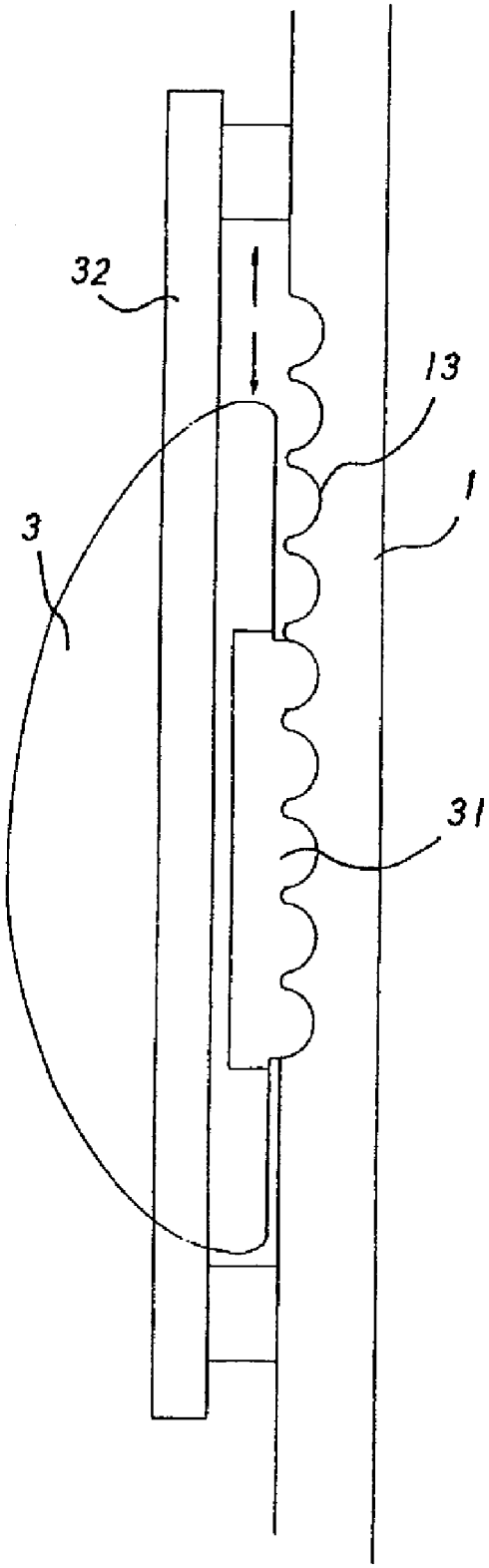
FIG. 6 is a side plan diagram illustrating the assembly of a support cushion of the rack structure for the chair according to the present invention.

To accommodate different users, each of two sides of the frame 1 is provided with a continuous arcuate groove 13 (as shown in FIG. 6), and each of two ends of the support cushion 3 is disposed with an arcuate protrusion 31 for being fixed into the continuous arcuate groove 13 by an elongated press member 32. The support cushion 3 may be adjusted upward and downward relative to the frame 1, thus maintaining the correct sitting posture.

Furthermore, the support cushion 3 includes foam materials filled therein for increasing comfort.

The invention is not limited to the above embodiment but various modifications thereof may be made. It will be understood by those skilled in the art that various changes in form and detail may be made without departing from the scope and spirit of the present invention.

What is claimed is:

1. A rack structure for a chair including;

a chair back member comprising a frame including two sides having a front, a back opposite to the front, a top end and a bottom end opposite to the top end; and a mounting support including two sides having top ends, wherein said frame includes a support cushion disposed on the front for supporting a user's waist, wherein the frame includes two first connecting tabs fixed on the back of the top ends of the two sides, wherein the frame includes two second connecting tabs formed on and extending from the two sides;

wherein said mounting support is fixed onto a base and extends upwardly therefrom, wherein the mounting support includes two coupling segments arranged on the top ends of the mounting support, wherein the two sides of the mounting support further includes two connecting projections intermediate the two coupling segments and the base, and each coupling segment and each connecting projection is couplingly attached in the mounting support by a resilient member, wherein said two first connecting tabs of said frame are connected with said two coupling segments and said two second connecting tabs are connected to the two connecting projections of said mounting support individually, with the two second connecting tabs located intermediate the support cushion and the two first connecting tabs, wherein the cushion is adjustably disposed on the front of the frame, wherein a continuous arcuate groove is provided on the front of each of the two sides of the frame, and wherein an arcuate protrusion is disposed on the support cushion for being fixed to each of the continuous arcuate grooves of the frame.

2. The rack structure for the chair as claimed in claim 1, wherein said support cushion includes foam materials filled therein for increasing comfort.

* * * * *